US010465416B2

(12) United States Patent
Criner et al.

(10) Patent No.: US 10,465,416 B2
(45) Date of Patent: Nov. 5, 2019

(54) HANDLE TRAY FOR FASCIA PANEL OF AN APPLIANCE

(71) Applicants: BSH Home Appliances Corporation, Irvine, CA (US); BSH Hausgeräte GmbH, Munich (DE)

(72) Inventors: Mia Criner, New Bern, NC (US); David Hite, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/199,324

(22) Filed: Nov. 26, 2018

(65) Prior Publication Data

US 2019/0093388 A1 Mar. 28, 2019

Related U.S. Application Data

(62) Division of application No. 15/643,583, filed on Jul. 7, 2017, now Pat. No. 10,227,793, which is a division of application No. 14/875,756, filed on Oct. 6, 2015, now Pat. No. 9,803,389.

(51) Int. Cl.

| | |
|---|---|
| ***E05B 1/00*** | (2006.01) |
| ***A47L 15/42*** | (2006.01) |
| *F25D 23/02* | (2006.01) |

(52) U.S. Cl.

CPC ..... *E05B 1/0015* (2013.01); *A47L 15/4257* (2013.01); *F25D 23/028* (2013.01)

(58) Field of Classification Search

CPC .... A45D 24/10; A47L 15/4257; E05B 1/0015

USPC ..... 312/228, 326, 348.6; 16/110.1, 412, 415

See application file for complete search history.

(56) References Cited

U.S. PATENT DOCUMENTS

| | | | | |
|---|---|---|---|---|
| 2,237,611 | A * | 4/1941 | Motley | A45D 24/10 132/147 |
| 2,695,690 | A | 11/1954 | Rees et al. | |
| 3,010,459 | A * | 11/1961 | Lerner | A45D 2/00 132/148 |
| 3,098,686 | A | 7/1963 | Benoit | |
| 3,412,421 | A | 11/1968 | Gerber | |
| 4,732,430 | A | 3/1988 | Byrns | |
| 5,174,618 | A | 12/1992 | Kropf | |

(Continued)

FOREIGN PATENT DOCUMENTS

| | | | |
|---|---|---|---|
| BE | 1018812 | A3 | 9/2011 |
| CN | 202709613 | U | 1/2013 |

(Continued)

*Primary Examiner* — James O Hansen

(74) *Attorney, Agent, or Firm* — Michael E. Tschupp; Andre Pallapies; Brandon G. Braun

(57) ABSTRACT

A domestic appliance for treating items may include a cabinet having a plurality of walls at least partly defining an interior chamber for treating items; a door assembly to enclose the interior chamber; a fascia panel attached to the door assembly, the fascia panel having a handle shell that at least partly defines a handle recess on the fascia panel, and the fascia panel having at least one fascia panel rib formed on an interior surface of the fascia panel opposite the handle shell; a handle tray having a main body and at least one finger extending from the main body, the at least one finger structured to be positioned adjacent to the at least one fascia panel rib.

5 Claims, 7 Drawing Sheets

(56) References Cited

U.S. PATENT DOCUMENTS

| | | | | |
|---|---|---|---|---|
| 5,303,451 | A | 4/1994 | Graviss et al. | |
| 5,427,127 | A | 6/1995 | Nogi et al. | |
| 5,921,648 | A | 7/1999 | Rong | |
| 5,927,836 | A | 7/1999 | Herr et al. | |
| 6,527,315 | B2 | 3/2003 | Marks et al. | |
| 6,666,219 | B2 | 12/2003 | Raches | |
| 6,948,788 | B1 | 9/2005 | Tai | |
| 8,337,631 | B2 | 12/2012 | Brown-West et al. | |
| 8,435,358 | B2 | 5/2013 | Disch et al. | |
| 9,205,951 | B1 * | 12/2015 | Roman | B65D 21/0233 |
| 2003/0205952 | A1 | 11/2003 | DiEnno et al. | |
| 2005/0157103 | A1 * | 7/2005 | Silverbrook | B41J 2/14427 347/85 |
| 2011/0155192 | A1 | 6/2011 | Ahmad et al. | |
| 2011/0247276 | A1 | 10/2011 | Egger et al. | |
| 2013/0113351 | A1 | 5/2013 | Eng | |
| 2016/0186984 | A1 | 6/2016 | Giacomini et al. | |
| 2017/0006992 | A1 * | 1/2017 | Barr | A45D 24/10 |

FOREIGN PATENT DOCUMENTS

| | | | |
|---|---|---|---|
| DE | 19907233 | A1 | 8/2000 |
| EP | 2514350 | A1 | 10/2012 |
| WO | 2008053348 | A2 | 5/2008 |
| WO | 2011151150 | A2 | 11/2011 |

* cited by examiner

HANDLE TRAY FOR FASCIA PANEL OF AN APPLIANCE

CROSS-REFERENCE OF RELATED APPLICATIONS

This application is a Divisional, under 35 U.S.C. § 121, of U.S. application Ser. No. 15/643,583, filed Jul. 7, 2017, now U.S. Pat. No. 10,227,793 issued on Mar. 12, 2019; which is a Divisional, under 35 U.S.C. § 121, of U.S. application Ser. No. 14/875,756, filed Oct. 6, 2015, now U.S. Pat. No. 9,803,389 issued on Oct. 31, 2017.

FIELD OF TECHNOLOGY

The present technology is directed to a tray for a handle formed on a fascia panel of an appliance, e.g., a domestic appliance. The fascia panel may be a component of a door assembly on the appliance.

BACKGROUND OF TECHNOLOGY

Appliances, including domestic appliances, may have a door to enclose an interior chamber in which items are treated by the appliance. The door provides access to the interior chamber to allow the user add and remove items for treatment, while also enclosing the interior chamber during treatment of the items.

Examples of a domestic appliance include: dishwasher, washer, dryer, washer/dryer combination, microwave, oven, toaster oven, refrigerator, and freezer. While the present technology is described in the context of appliances, including domestic appliances, it should be understood that the present technology is applicable to other contexts that relate to a handle and a fascia panel.

As described above, the door may provide access for the user to add and remove items from the appliance for treatment. Therefore, the door may be user-facing, i.e., the door itself is accessible to the user to be opened and closed. In other words, the exterior of the door is at least one part of the appliance that is exposed to the user. Since the door may be exposed to the user and, in the case of a domestic appliance a visible fixture within the home, it may be desirable for the door to have appealing aesthetics.

To provide this appealing aesthetic, any exposed portion of the appliance, including the door, may be designed in a visually appealing manner. For example, the door may have a one or more panels that cover a significant amount of the visible portions of the front door. Also, since the door is used for access, a handle may be formed in one or more of the panels to allow the user to manually open and close the door. Other related considerations in designing a panel for an appliance door, include a design that is easy to manufacture inexpensively and repeatably, but with minimal defects in the visible surface portions.

Making a panel for the appliance door as a molded plastic part is a way to balance these considerations, particularly the cost consideration. Molding a panel from plastic involves further considerations. For example, the visible portions of the panel should have a wall thickness that is as constant as possible. A constant wall thickness allows for laminar flow of the plastic material, which in turn reduces defects on surfaces, including the visible ones. Also, ribs may be molded on the panel as well. However, it may be desirable to minimize the number of ribs needed because molding ribs may cause the opposite surface, i.e., the surface visible to the user, to sink. Sinking in the visible surfaces may also be reduced by making the ribs thinner than the visible surface.

Other considerations are also relevant in molding a panel for an appliance door from plastic. Once the material of the panel is injected into the mold tool and the panel is formed, the tool parts must be withdrawn from one another to allow extraction of the molded panel. Where the tool parts are separated, a parting edge may be formed. It may be undesirable for the parting edge to be visible to the user because it may not be visually pleasing and it may be undesirable for the parting edge to be accessible to the user's touch because it may not be tactilely pleasing.

In the context of forming a handle recess in a panel for an appliance door, the handle may be formed as a recess in the panel. Accordingly, it may be possible to mold the panel so that the parting edge is completely concealed from sight and feel in the recess. An example of how this issue may be addressed is shown in the prior art technology of FIG. 11. A fascia panel 12 is formed with a handle recess 13, which results in a parting edge region 26 that is covered from the user's touch and feel by a part 25. As can be seen in FIG. 11, the portion of the part 25 that extends from the handle recess 13 and wraps around the parting edge region would be visible to the user, i.e., it is cosmetic. FIG. 13 shows another prior art technology where the user can touch the parting edge region 26 on the fascia panel. Accordingly, the considerations relating to a visually appealing design for a plastic part described above must be taken into account for the part 25, which adds cost for producing this part.

Also, the part 25 must be secured to the fascia panel 12. FIG. 12 depicts another part 27 similar to the part 25. The part 27 may be provided with holes 28 to receive clips to secure the part 27 to the fascia panel 12. Alternatively, screws may be used to attach the part 25, 27 to the fascia panel 12. These attachment methods are not ideal, because they may allow the part 25, 27 to move, which can cause noise and/or an undesirably cheap feeling for the user.

BRIEF SUMMARY OF TECHNOLOGY

The present technology includes improvements to the prior art technologies, while also taking into account the design considerations described above.

An aspect of the present technology is directed to a handle tray for a fascia panel of a door of an appliance, e.g., a domestic appliance.

Another aspect of the present technology is directed to a door assembly for an appliance, e.g., a domestic appliance, which includes a handle tray.

Another aspect of the present technology is directed to an appliance, e.g., a domestic appliance, which includes an interior chamber, a door to provide access to the interior chamber, a fascia panel for the door, and a handle tray for the fascia panel.

Another aspect of the present technology is directed to a domestic appliance for treating items. The domestic appliance may comprise: a cabinet having a plurality of walls at least partly defining an interior chamber for treating items; a door assembly to enclose the interior chamber; a fascia panel attached to the door assembly, the fascia panel having a handle shell that at least partly defines a handle recess on the fascia panel, and the fascia panel having at least one fascia panel rib formed on an interior surface of the fascia panel opposite the handle shell; a handle tray having a main body and at least one finger extending from the main body, the at least one finger structured to be positioned adjacent to the at least one fascia panel rib.

In examples, (a) the handle tray may be releasably attachable to the fascia panel such that when the handle tray is attached to the fascia panel a portion of the at least one fascia panel rib is covered by the main body, (b) the at least one fascia panel rib may comprise a plurality of fascia panel ribs and the at least one finger may comprise a plurality of fingers, said fingers being structured to fit between corresponding fascia panel ribs such that the fascia panel ribs and the fingers alternate when the handle tray is attached to the fascia panel, (c) the handle shell may comprise a hole and the handle tray may comprise a tab having a snap hook, the tab extending from the main body, and the tab may be structured to pass through the hole to engage the snap hook with the hole at an outer surface of the handle shell to at least partially attach the handle tray to the handle shell of the fascia panel, (d) the handle tray may comprise a slot to at least partially define a spring feature, said spring feature being structured to engage the handle shell at an inside surface and generate an attachment force in an opposite direction to the engagement of the snap hook with the hole to attach the handle tray to the fascia panel, (e) the spring feature may further comprise a cantilevered beam or a fixed beam such that the spring feature is deflected into the slot when the handle tray is attached to the fascia panel, (f) the spring feature may be curved to engage with a correspondingly curved portion of the handle shell when the handle tray is attached to the fascia panel, (g) the handle tray may further comprise at least one handle tray rib to contact the fascia panel ribs such that the handle tray is supported against the fascia panel to resist deformation when the handle tray is grasped by the user, (h) the handle tray may comprise at least one parting edge that is recessed below the at least one fascia panel rib such that the at least one parting edge is hidden from a user's touch when the handle tray is attached to the fascia panel, (i) the handle tray may comprise liquid silicone rubber or thermoplastic elastomer, and/or (j) the handle tray may comprise a light-transmissive material.

Another aspect of the present technology is directed to a door assembly for an appliance. The door assembly may comprise: a front panel; a fascia panel attached to the front panel, the fascia panel having a handle shell that at least partly defines a handle recess on the fascia panel, and the fascia panel having at least one fascia panel rib formed on an interior surface of the fascia panel opposite the handle shell; a handle tray having a main body and at least one finger extending from the main body, the at least one finger structured to be positioned adjacent to the at least one fascia panel rib.

In examples, (a) the handle tray may be releasably attachable to the fascia panel such that when the handle tray is attached to the fascia panel a portion of the at least one fascia panel rib is covered by the main body, (b) the at least one fascia panel rib may comprise a plurality of fascia panel ribs and the at least one finger may comprise a plurality of fingers, said fingers being structured to fit between corresponding fascia panel ribs such that the fascia panel ribs and the fingers alternate when the handle tray is attached to the fascia panel, (c) the handle shell may comprise a hole and the handle tray may comprise a tab having a snap hook, the tab extending from the main body, and the tab may be structured to pass through the hole to engage the snap hook with the hole at an outer surface of the handle shell to at least partially attach the handle tray to the handle shell of the fascia panel, (d) the handle tray may comprise a slot to at least partially define a spring feature, said spring feature being structured to engage the handle shell at an inside surface and generate an attachment force in an opposite direction to the engagement of the snap hook with the hole to attach the handle tray to the fascia panel, (e) the spring feature may further comprise a cantilevered beam or a fixed beam such that the spring feature is deflected into the slot when the handle tray is attached to the fascia panel, (f) the spring feature may be curved to engage with a correspondingly curved portion of the handle shell when the handle tray is attached to the fascia panel, (g) the handle tray may further comprise at least one handle tray rib to contact the fascia panel ribs such that the handle tray is supported against the fascia panel to resist deformation when the handle tray is grasped by the user, (h) the handle tray may comprise at least one parting edge that is recessed below the at least one fascia panel rib such that the at least one parting edge is hidden from a user's touch when the handle tray is attached to the fascia panel, (i) the handle tray may comprise liquid silicone rubber or thermoplastic elastomer, and/or (j) the handle tray may comprise a light-transmissive material.

Another aspect of the present technology is directed to a handle tray for a fascia panel of a door assembly of an appliance. The handle tray may comprise: a main body; a plurality of fingers extending from the main body; and at least one attachment structure extending from the main body in an opposite direction from the plurality of fingers, the at least one attachment structure being configured to releasably attach the handle tray to the fascia panel.

In examples, (a) said fingers may be structured to fit between fascia panel ribs of the fascia panel such that the fascia panel ribs and the fingers alternate when the handle tray is attached to the fascia panel, (b) the at least one attachment structure may comprise a tab having a snap hook, the tab extending from the main body, and the snap hook may be structured to engage with a hole of the fascia panel to at least partially attach the handle tray to the fascia panel, (c) the handle tray may comprise a slot to at least partially define a spring feature, said spring feature being structured to engage the fascia panel to generate an attachment force in an opposite direction to the engagement of the snap hook with the hole to attach the handle tray to the fascia panel, and/or (d) the spring feature may further comprise a cantilevered beam or a fixed beam such that the spring feature is deflected into the slot when the handle tray is attached to the fascia panel.

Of course, portions of the aspects may form sub-aspects of the present technology. Also, various ones of the sub-aspects and/or aspects may be combined in various manners and also constitute additional aspects or sub-aspects of the present technology.

Other features of the technology will be apparent from consideration of the information contained in the following detailed description, abstract, drawings and claims.

DETAILED DESCRIPTION OF TECHNOLOGY

Before the present technology is described in further detail, it is to be understood that the technology is not limited to the particular examples described herein, which may vary. It is also to be understood that the terminology used in this disclosure is for the purpose of describing only the particular examples discussed herein, and is not intended to be limiting.

The following description is provided in relation to various examples which may share one or more common characteristics and/or features. It is to be understood that one or more features of any one example may be combinable with one or more features of another example or other examples. In addition, any single feature or combination of features in any of the examples may constitute a further example.

Figure 1A:
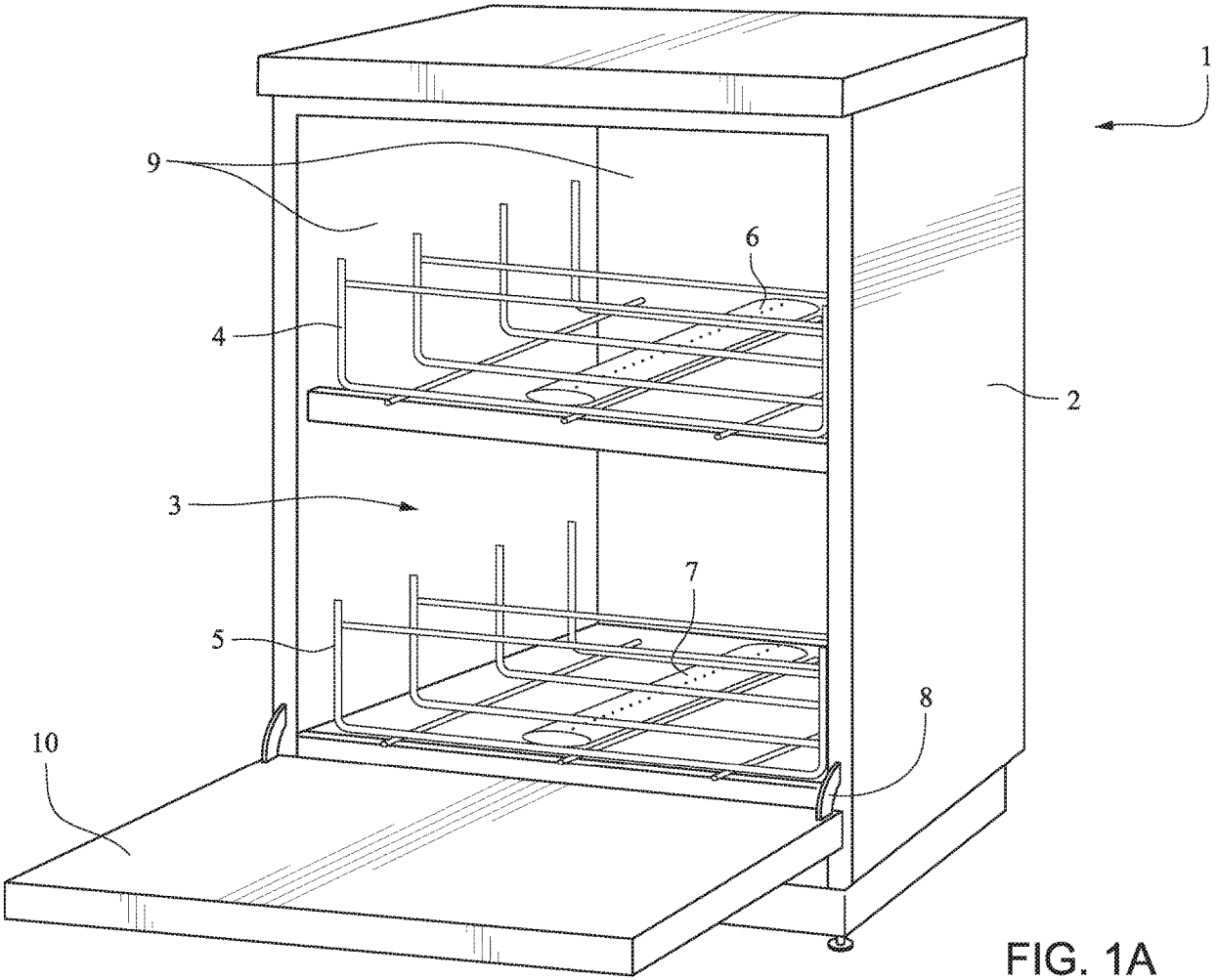
FIG. 1A is a front perspective view of an appliance according to an example of the present technology.

FIG. 1A depicts an appliance 1 according to an example of the present technology. The appliance 1 depicted in FIG. 1A may be a domestic appliance and it may also be water-bearing, e.g., a dishwasher. It should be understood that the present technology may also be applicable to other appliances, e.g., washer, dryer, washer/dryer combination, microwave, oven, toaster oven, refrigerator, and freezer. While the present technology is described in the context of appliances, including domestic appliances, it should be understood that the present technology is applicable to other contexts that relate to a handle and a fascia panel.

The exemplary appliance 1 in FIG. 1A also may include a cabinet 2 with walls 9 that at least partially define an interior chamber 3. There may be top, bottom, and side walls 9. Items (not shown) to be treated by the appliance 1 may be added to the interior chamber 3 for treatment. The interior chamber 3 may also include at least one rack for supporting the items during treatment and the depicted example includes an upper rack 4 and a lower rack 5. The appliance 1 may be provided with more than two racks, if desired for the particular application. Treatment of the items by the appliance 1 may be performed, at least in part, by sprayers where the appliance 1 is a dishwasher. The example depicted in FIG. 1A includes an upper sprayer 6 and a lower sprayer 7. The appliance 1 may be provided with more than two sprayers, if desired for the particular application. The sprayers 6, 7 may be movable and may treat items, e.g., crockery, via jets of water or other washing liquids.

The appliance 1 may also have a door assembly 10 to enclose the interior chamber 3 during treatment of the items. The door assembly 10 may be attached to the cabinet 2 by hinges 8 to allow the door assembly 10 to open and close the interior chamber 3, e.g., to allow a user to add items prior to treatment, to remove items after treatment, or to enclose the interior chamber 3 during treatment. In FIG. 1A, the door assembly 10 is open such that the structures and components inside of the interior chamber 3 are visible.

Figure 1B:
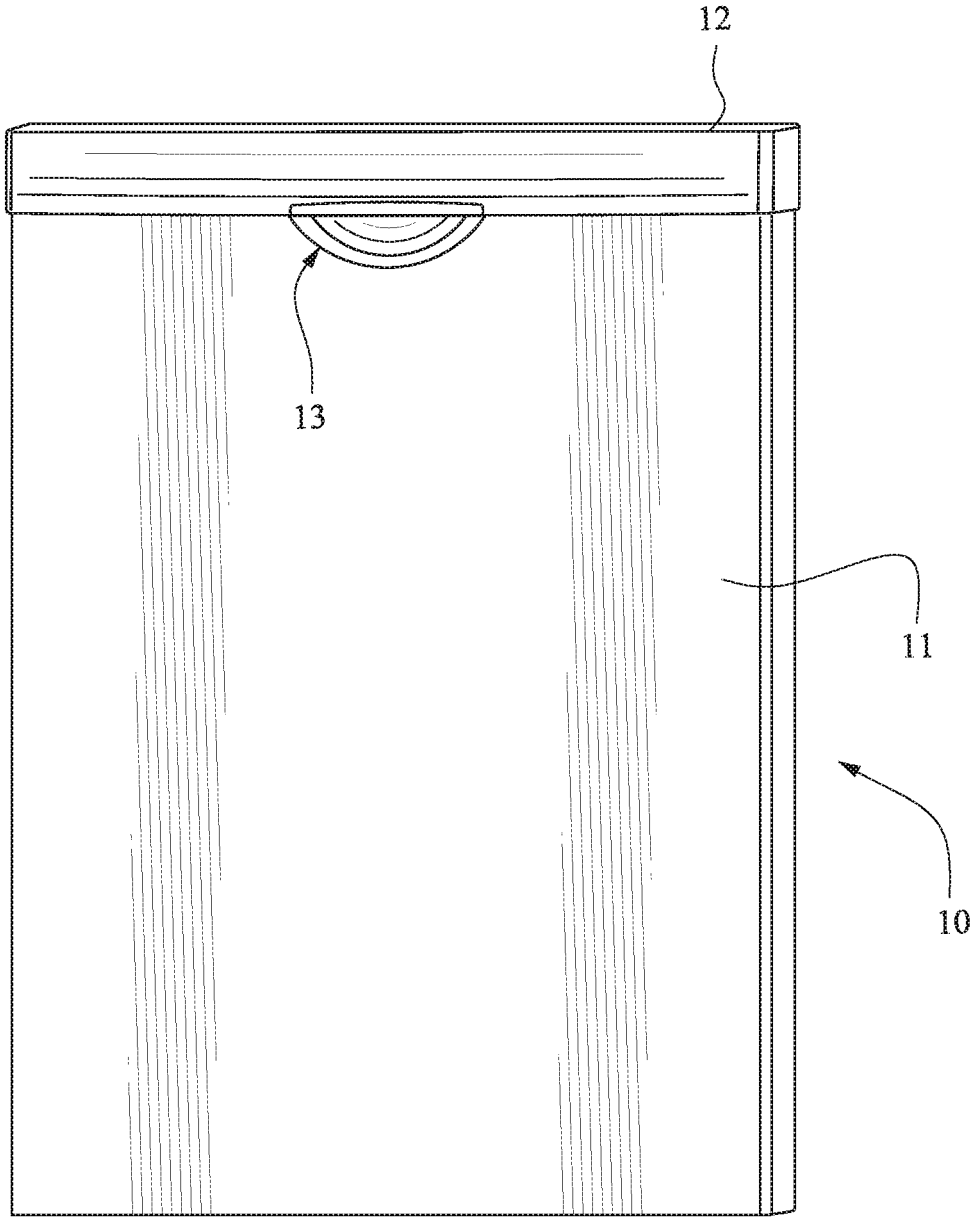
FIG. 1B is a front perspective view of a door assembly for an appliance according to an example of the present technology.

FIG. 1B depicts a front view of a door assembly 10 according to an example of the present technology. The door assembly 10 may include a front panel 11. The front panel 11 may be exposed to the user when the appliance 1 is installed in the user's home such that it may be advantageous to produce the front panel 11 with visually appealing characteristics, e.g., high-quality materials and finishes, as well as minimal visible defects in the visible surfaces. The front panel 11 may be made from metal or plastic. The door assembly 10 may also include a fascia panel 12 that may be attached to a frame (not shown) of the door assembly 10 and/or to the front panel 11. The door assembly 10 may also include a handle recess 13. In the example shown in FIG. 1B, the handle recess 13 is partly defined by the front panel 11 and partly defined by the fascia panel 12. In other examples, the handle recess may be formed exclusively in the fascia panel 12.

Figure 2A:
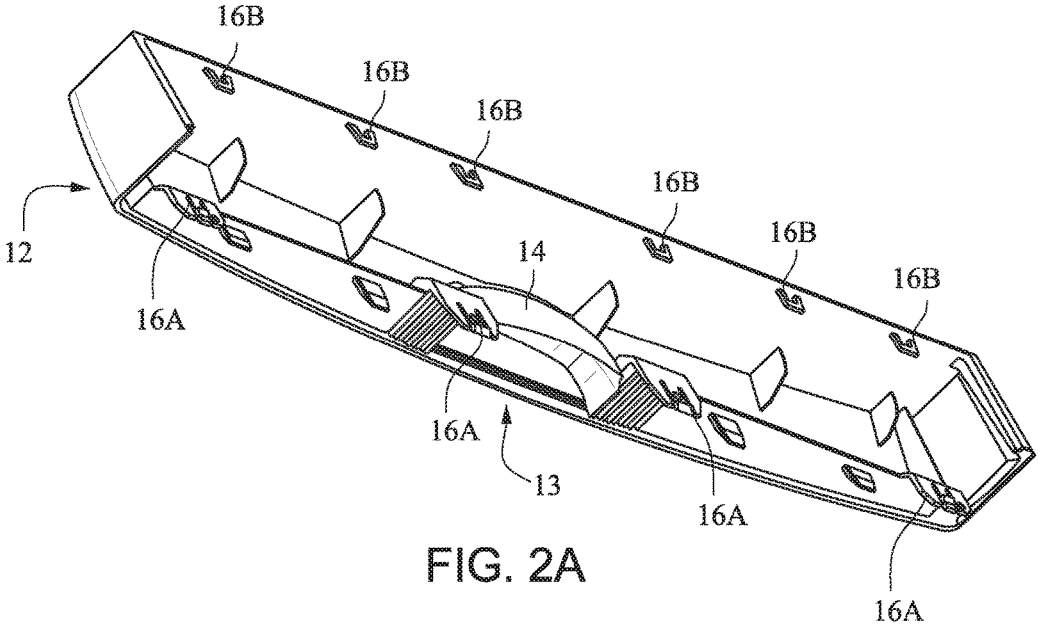
FIG. 2A is rear perspective view of a fascia panel according to an example of the present technology.

FIG. 2A depicts a rear perspective view of an exemplary fascia panel 12. FIG. 2A shows first attachment structures 16 and second attachment structures 16B. The first attachment structures 16A and the second attachment structures 16B may be used to attach the fascia panel 12 to the front panel 11 and/or to the frame of the door assembly 10, as explained above. Additionally, fasteners, e.g., screws or rivets, may also be used with the first attachment structures 16A and the second attachment structures 16B to attach the fascia panel 12 to the front panel 11 and/or to the frame of the door assembly 10. The fascia panel 12 may also include a handle shell 14 that at least partly defines the handle recess 13. The fascia panel 12 may be molded from a plastic material to form a single continuous piece of homogeneous material.

Figure 2B:
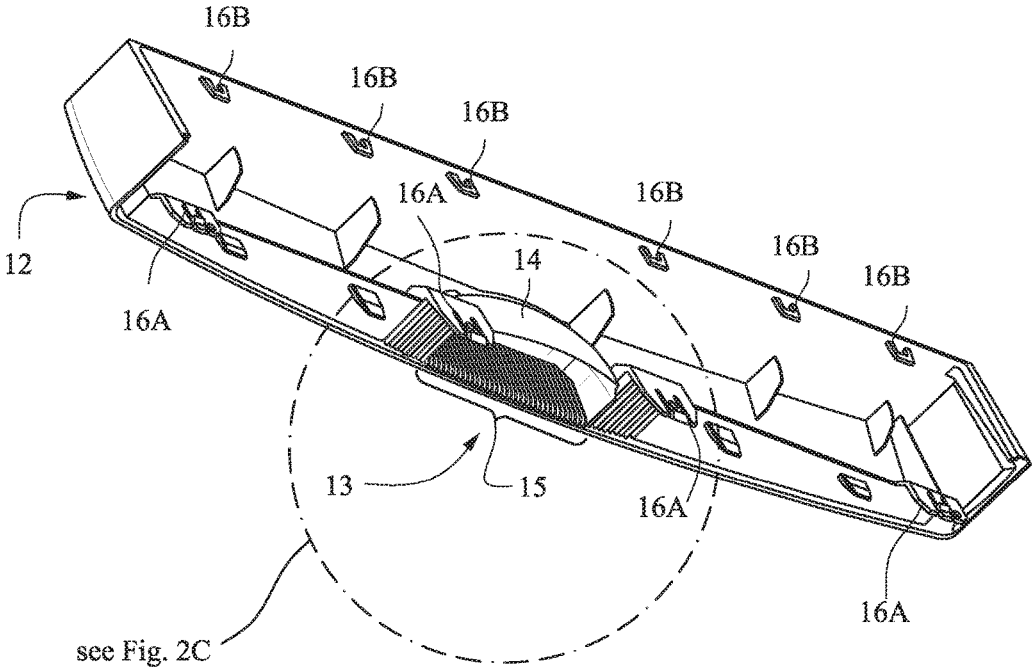
FIG. 2B is rear perspective view of another fascia panel according to an example of the present technology.

In FIG. 2A, the interior surface of the fascia panel 12 that, with the handle shell 14, at least partly defines the handle recess 13 is generally smooth, as compared to the example in FIG. 2B. In the example in FIG. 2B, at least one fascia panel rib 15 is included on this surface of the fascia panel 12 to provide strength. FIG. 2B depicts an example with a plurality of fascia panel ribs 15. The fascia panel ribs 15 may be understood to provide structural strength to this portion of the fascia panel 12, because the user will likely grip the door assembly 10 and the fascia panel 12 in the handle recess 13 when the user opens and closes the door assembly 10. Therefore, the example of the fascia panel 12 in FIG. 2B that includes the fascia panel ribs 15 may be less susceptible to cracking, damage, and/or wear due to the increased structural strength of the fascia panel ribs 15.

Figure 2C:
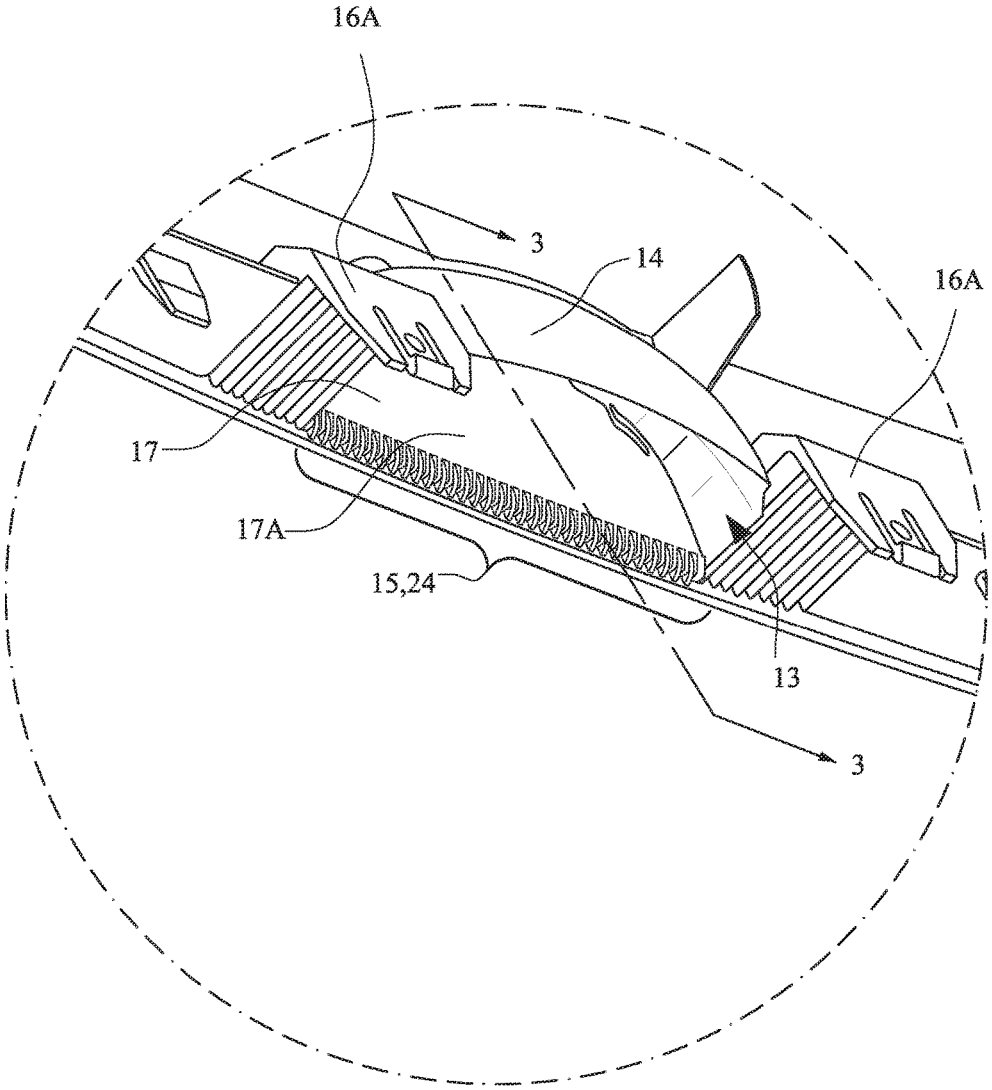
FIG. 2C is a detailed view of the fascia panel of FIG. 2B with a handle tray according to an example of the present technology.

While the addition of the fascia panel ribs 15 to the fascia panel 12 may provide increased strength, the user may grip the fascia panel 12 in the region of the fascia panel ribs 15 and the fascia panel ribs 15 may be uncomfortable for the user to touch. Thus, as shown in FIG. 2C, a handle tray 17 may be installed to the fascia panel 12 over the fascia panel ribs 15 and in the handle recess 13. The handle tray 17 may have a main body 17A that is substantially smooth such that when the user grabs the handle recess 13 at the fascia panel 12 to open or close the door assembly 10, the user's fingers will contact the smooth main body 17A of the handle tray 17, as opposed to the fascia panel ribs 15. Accordingly, the handle tray 17 and its main body 17A may provide a better tactile feel for the user, because the main body 17A covers at least a portion of the fascia panel ribs 15.

Figure 3:
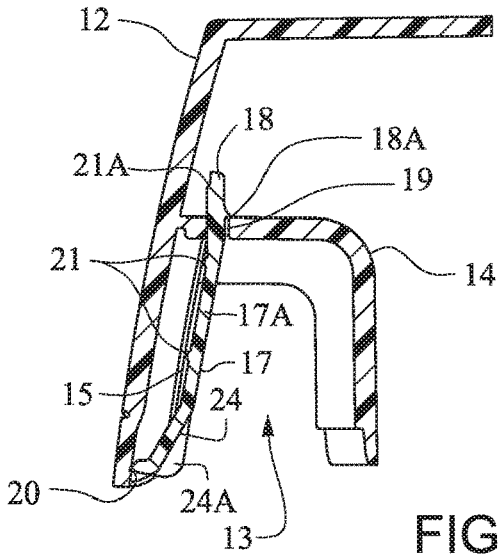
FIG. 3 is a cross-sectional view of the fascia panel and handle tray taken through line 3-3 of FIG. 2C.
Figure 4:
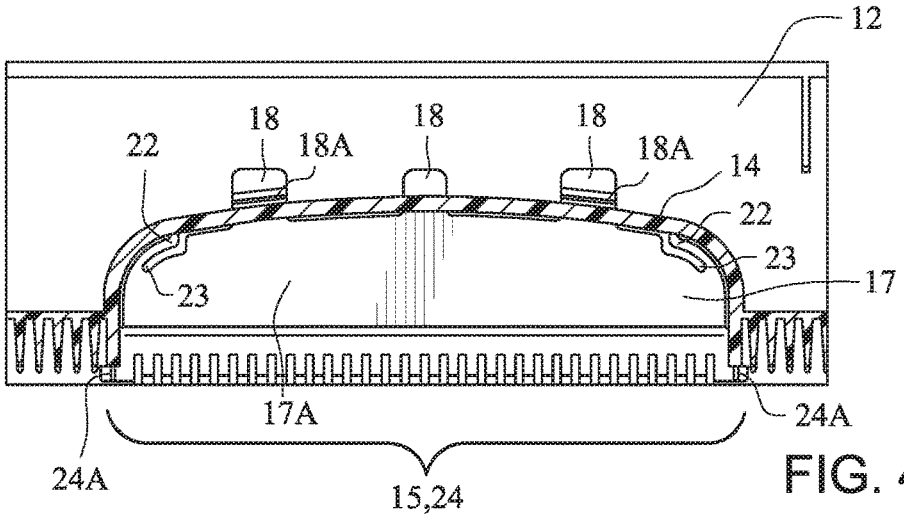
FIG. 4 is a rear view of a fascia panel with a handle tray according to an example of the present technology.
Figure 5:
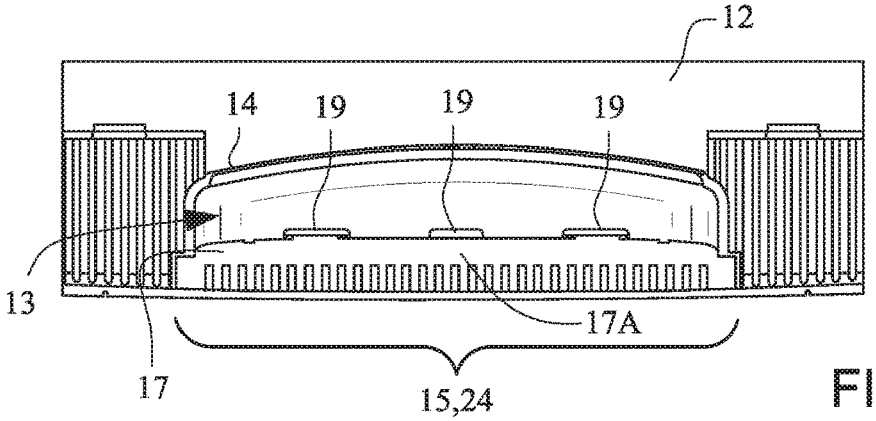
FIG. 5 is a bottom view of a fascia panel with a handle tray according to an example of the present technology.

FIGS. 3-5 depict additional views of the handle tray 17 installed on the fascia panel 12, as well as additional features of the exemplary fascia panel 12 and handle tray 17. The handle tray 17 may be provided with at least one attachment part, e.g., at least one tab 18, to attach the handle tray 17 to the fascia panel 12. Accordingly, the handle tray 17 may be understood to be releasably attachable to the fascia panel 12. The handle shell 14 may also have at least one hole 19 that receives a corresponding tab 18 of the handle tray 17. The tab 18 may have a snap hook 18A that engages with the handle shell 14 at the hole 19 to secure or attach the handle tray 17 to the fascia panel 12 via the handle shell 14. FIGS. 4 and 5 depict three tabs 18 and three corresponding holes 19, however, it should be understood that more or fewer tabs 18 and holes 19 may also be provided for attachment purposes. The tabs 18 may extend from the main body 17A of the handle tray 17 in cantilever fashion.

The snap hook 18A, when engaged with the handle shell 14 at the hole 19, resists pulling the handle tray 17 away from the handle shell 14 and out of the handle recess 13. The handle tray 17 may also include at least one spring feature 22 that also serves to attach or secure the handle tray 17 to the handle shell 14 by generating an attachment force in an opposite or generally opposite direction to the engagement of the snap hook 18A with the hole 19 to attach the handle tray 17 to the fascia panel 12. The spring features 22 may extend from the main body 17A of the handle tray 17 in cantilever fashion, i.e., the spring feature 22 is a cantilever beam. The spring features 22 may be defined, at least partly, by a slot 23 that is cut into the main body 17A of the handle tray 17. The slots 23 form a space into which the corresponding spring features 22 deflect when the handle tray 17 is attached to the handle shell 14 of the fascia panel 12. The handle tray 17 may be made from an elastic material, e.g., liquid silicone rubber or thermoplastic elastomer, which allows the spring feature 22 to deflect and also, by virtue of the material's elasticity, to generate an attachment force in an opposite direction to the engagement of the snap hook 18A with the hole 19 to attach the handle tray 17 to the fascia panel 12. The material of the handle tray 17 may be light-transmissive. The spring feature 22 may also be curved such that it corresponds to the curved shape of the handle shell 14 at a corresponding portion. The spring features 22 may be deflected when the handle tray 17 is installed such that they hold the handle tray 17 against the against the handle shell 14 with a constant force that prevents the handle tray 17 from moving against the fascia panel 12 or the handle shell 14 in a way the generates noise, e.g., clicking.

Figure 7:
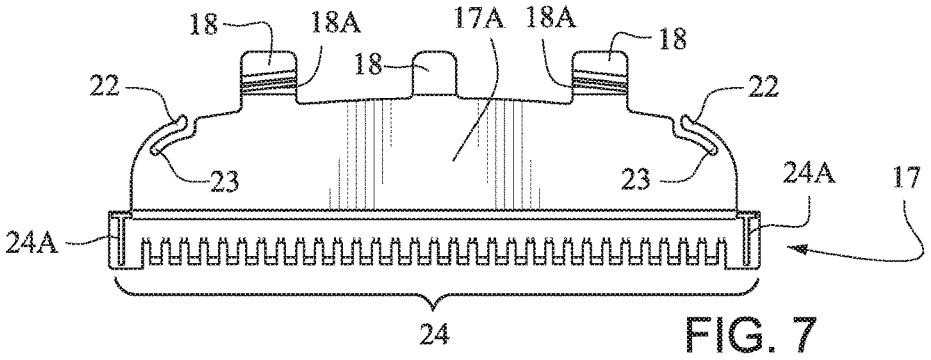
FIG. 7 is a rear view of a handle tray according to an example of the present technology.
Figure 7A:
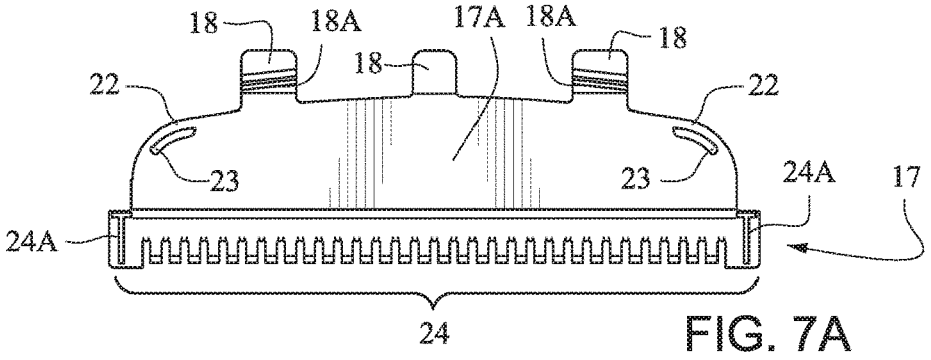
FIG. 7A is a rear view of a handle tray according to an example of the present technology.

FIG. 7A shows a variation of the example in FIG. 7 where the spring feature 22 is not cantilevered. Rather, the spring feature 22 in this variation spans the slot 23 such that the spring feature 22 is joined to the main body 17A of the handle tray 17 at each end of the slot 23. In other words, the spring feature 22 is a fixed beam that is fixed to the main body 17A at each of its ends. The function is essentially the same as the example in FIG. 7 in that the spring feature 22 is deflected into the slot 23 when the handle tray 17 is installed such that the elasticity of the spring feature 22 opposes the snap hook's 18A retention force to maintain the handle tray 17 in a securely installed position.

The handle tray 17 also includes at least one finger 24 that is structured to be positioned adjacent to the at least one fascia panel rib 15. FIGS. 4 and 5 depict an example where there are a plurality of fascia panel ribs 15 and a plurality of fingers 24. In this example, the fingers 24 are structured to fit between corresponding fascia panel ribs 15 such that the fascia panel ribs 15 and the fingers 24 alternate when the handle tray 17 is attached to the fascia panel 12. As can be seen in the cross-sectional view of FIG. 3, the fascia panel ribs 15 and the fingers 24 are alternating and, in addition to their respective shapes, this provides a smooth transition from the fascia panel ribs 15 to the fingers 24 and then to the main body 17A of the handle tray 17 such that the user feels a generally smooth surface as opposed to if the user were to just grasp the fascia panel ribs 15 without the handle tray 17. The fingers 24 may also be understood to help the handle tray 17 maintain its position in the handle recess 13 in a depth direction, i.e., a direction perpendicular to the direction of forces generated by the snap hooks 18A and the spring features 22.

Figure 6:
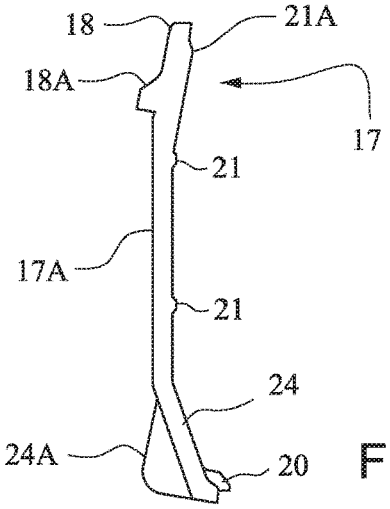
FIG. 6 is a side view of a handle tray according to an example of the present technology.

FIGS. 6-10 show views of the handle tray 17 alone. FIG. 6, as well as FIG. 3, show that the handle tray 17 may also include at least one handle tray rib 21 to ensure that the handle tray 17 is in contact with the fascia panel 12 when the handle tray 17 is installed. The contact between the handle tray 17 and the fascia panel 12 prevents the user from feeling that there is a space between the handle tray 17 and the fascia panel 12. For example, the handle tray ribs 21 can prevent the handle tray 17 from deforming and being pressed against the fascia panel 12 and that could result in undesirable noise, e.g., clicking, that may be perceptible to the user. As can be seen in FIG. 3, the handle tray ribs 21 are spaced apart on the handle tray 17 to provide an even distribution of contact with the fascia panel ribs 15. Handle tray ribs 21 may be provided on the handle tray 17 to contact the fascia panel 12 and/or the handle shell 14 in other areas in addition or in the alternative to the location of the handle tray ribs 21 shown in FIG. 3 to provide sufficient resistance to deformation of the handle tray 17 when grasped by the user. The handle tray ribs 21 may be formed sufficiently small such their size and location in a mold can be adjusted to optimize the level of contact with the fascia panel 12, handle shell 14, and/or fascia panel ribs 15 to resist deformation and prevent movement and noise.

Figure 9:
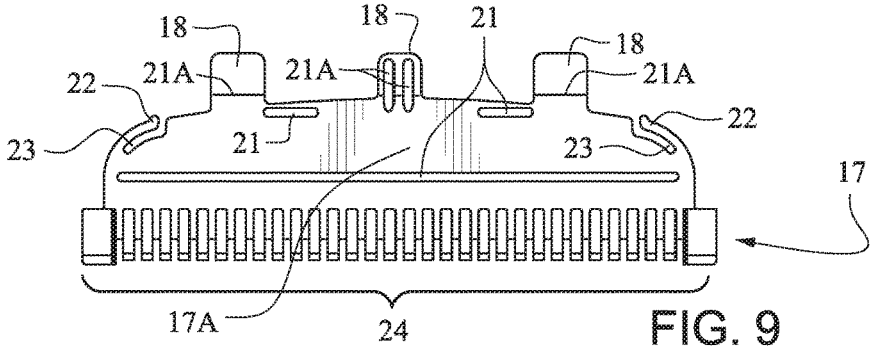
FIG. 9 is a front view of a handle tray according to an example of the present technology.
Figure 10:
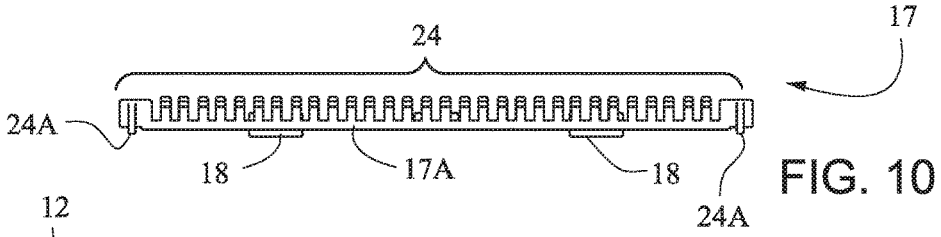
FIG. 10 is a bottom view of a handle tray according to an example of the present technology.
Figure 11:
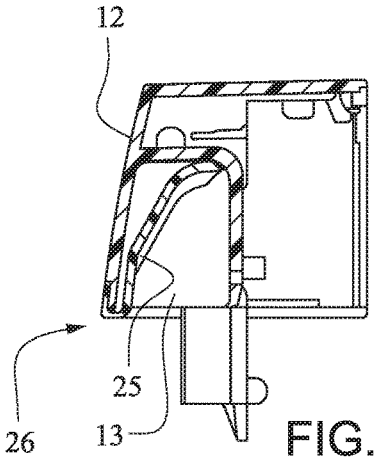
FIG. 11 (Prior Art)
FIG. 11 is a cross-sectional view of a fascia panel and a part according to a prior art technology.
Figure 12:
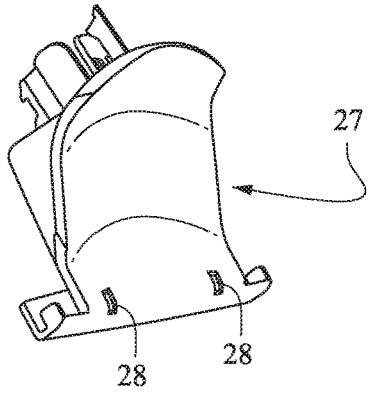
FIG. 12 (Prior Art)
FIG. 12 is a perspective view of a part according to a prior art technology.
Figure 13:
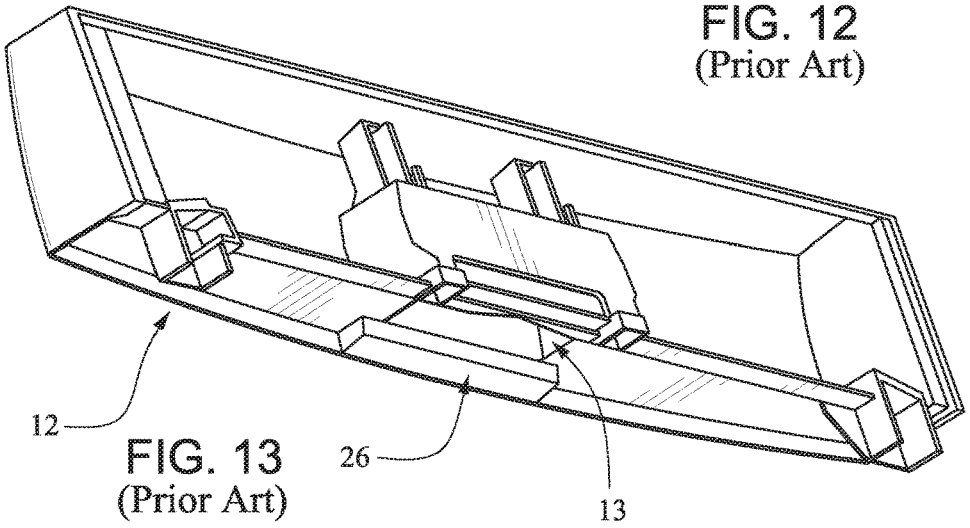
FIG. 13 (Prior Art)
FIG. 13 is a bottom perspective view of a fascia panel according to a prior art technology.

Additional handle tray ribs 21A may be provided on the tabs 18, as shown in FIGS. 3 and 9. These additional handle tray ribs 21A may ensure that the tabs 18 remain securely attached within the respective holes 19 by providing a force that counters the snap hooks 18A. In other words, the additional handle tray ribs 21A prevent the snap hooks 18A from being pulled out from their respective holes 19 at the handle shell 14 when the user grasps the handle tray 17.

The handle tray 17 may also have at least one parting edge 20 that results from the molding process by which the handle tray 17 is produced. The handle tray 17 may be shaped such that the parting edge 20 is recessed below the at least one fascia panel rib 15 such that the at least one parting edge 20 is hidden from the user's touch when the handle tray 17 is attached to the fascia panel 12.

Figure 8:
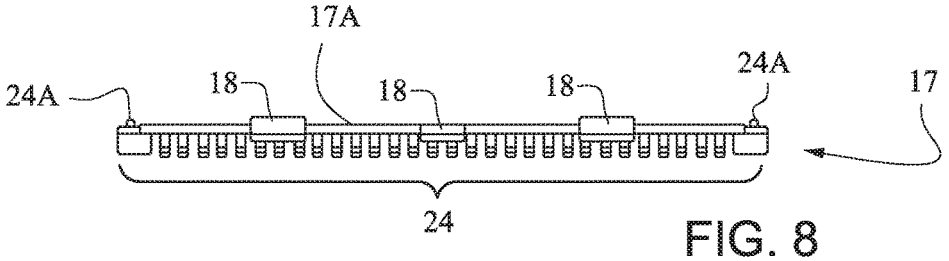
FIG. 8 is a top view of a handle tray according to an example of the present technology.

The handle tray 17 may also include at least one installation finger 24A that provides a surface against which force can be applied to install the handle tray 17 in the fascia panel 12. As can be seen in FIG. 3, once the ends of the fingers 24 are pushed past the bottom of the fascia panel ribs 15 the main body 17A of the handle tray 17 would be the only surface exposed which an installer could use to completely push the handle tray 17 into the installed position shown in FIG. 3. In that case finger friction against the main body 17A might be the only way to completely install the handle tray 17. This would make assembly difficult. However, the installation finger 24A on the handle tray 17 provides a surface against which the installer can push to fully attach the handle tray 17 to the fascia panel 12 such that the tabs 18 and snap hooks 18A fully engage with the holes 19 of the handle shell 14, because the installation finger 24A will remain exposed once the fingers 24 are pushed past the fascia panel ribs 15. Also, the handle tray 17 may have one installation finger 24A on each lateral side, as shown in FIGS. 5, 7, and 8, so that the installation fingers 24A are positioned proximal to the sides of the handle shell 14 to keep them out of the handle recess 13 and away from the user's grasp.

The handle tray 17, designed as shown in FIGS. 6-10, can be molded as a generally flat part, without undercuts, with a generally constant thickness, and from a variety of materials. Also, when the handle tray 17 is installed in the handle recess 13 it should be understood that it may be difficult, if not impossible, for the user to see, however, when the user grasps the handle recess 13 to open or close the door assembly 10 the user will be able to feel the handle tray 17. Also, the handle tray 17 is designed such that no parting edges of the handle tray 17 or the fascia panel 12 can be felt by the user when opening or closing the door assembly 10 by grasping the handle recess 13. The gradual transition between the fascia panel ribs 15 and the fingers 24 give the user a feeling of robustness such that they cannot tell that multiple parts have been used.

Although the technology herein has been described with reference to particular examples, it is to be understood that these examples are merely illustrative of the principles and applications of the technology. In some instances, the terminology and symbols may imply specific details that are not required to practice the technology. For example, although the terms "first" and "second" may be used, unless otherwise specified, they are not intended to indicate any order but may be utilized to distinguish between distinct elements. Furthermore, although process steps in the methodologies may be described or illustrated in an order, such an ordering is not required. Those skilled in the art will recognize that such ordering may be modified and/or aspects thereof may be conducted concurrently or even synchronously. It is therefore to be understood that numerous modifications may be made to the illustrative examples and that other arrangements may be devised without departing from the spirit and scope of the technology.

What is claimed is:

1. A handle tray for a fascia panel of a door assembly of an appliance, the handle tray comprising:

a main body defining an engagement side, an exposed side, and a pair of lateral sides;

a plurality of fingers extending from the main body in a comb-shaped fashion;

an installation finger disposed on each one of the lateral sides of the main body, with each installation finger protruding from the exposed side of the main body in an opposite direction from the engagement side of the main body; and at least one attachment part extending from the main body in an opposite direction from the plurality of fingers, the at least one attachment part being configured to releasably attach the handle tray to the fascia panel, wherein each of the plurality of fingers is structured to fit in between reinforcing fascia panel ribs of the fascia panel such that the reinforcing fascia panel ribs and the plurality of fingers alternate on condition that the handle tray is attached to the fascia panel, and wherein the at least one attachment part comprises a tab having a snap hook, the tab extending from the main body, and the snap book being structured to engage with a hole of the fascia panel to at least partially attach the handle tray to the fascia panel.

2. The handle tray of claim 1, further comprising a slot to at least partially define a spring feature, said spring feature being structured to engage the fascia panel to generate an attachment force in an opposite direction to the engagement of the snap hook with the hole to attach the handle tray to the fascia panel.

3. The handle tray of claim 2, wherein the spring feature further comprises a cantilevered beam or a fixed beam such that the spring feature is deflected into the slot when the handle tray is attached to the fascia panel.

4. A handle tray for a fascia panel of a door assembly of an appliance, the handle tray comprising:

a main body;

a plurality of fingers extending from the main body in a comb-shaped fashion; and at least one attachment part extending from the main body in an opposite direction from the plurality of fingers, the at least one attachment part being configured to releasably attach the handle tray to the fascia panel, wherein said fingers are structured to fit in between reinforcing fascia panel ribs of the fascia panel such that the reinforcing fascia panel ribs and the fingers alternate on condition that the handle tray is attached to the fascia panel, wherein the at least one attachment part comprises a tab having a snap hook, the tab extending from the main body, and wherein the snap hook is structured to engage with a hole of the fascia panel to at least partially attach the handle tray to the fascia panel, further comprising a slot to at least partially define a spring feature, said spring feature being structured to engage the fascia panel to generate an attachment force in an opposite direction to the engagement of the snap hook with the hole to attach the handle tray to the fascia panel.

5. The handle tray of claim 4, wherein the spring feature further comprises a cantilevered beam or a fixed beam such that the spring feature is deflected into the slot when the handle tray is attached to the fascia panel.

* * * * *